US005345247A

United States Patent [19]

Aldama et al.

[11] Patent Number: 5,345,247

[45] Date of Patent: Sep. 6, 1994

[54] FIVE-WAY ANTENNA SYSTEM

[75] Inventors: Alfredo Aldama, Miami, Fla.; Ralph W. Crudo, Regal Park, N.Y.

[73] Assignee: Algira Primo Inc., Brooklyn, N.Y.

[21] Appl. No.: 976,155

[22] Filed: Nov. 13, 1992

[51] Int. Cl.[5] ..... H01Q 9/04

[52] U.S. Cl. ..... 343/791; 343/715; 343/853; 343/893

[58] Field of Search ..... 343/715, 787, 788, 791, 343/853, 872, 893, 895, 722, 751

[56] References Cited

U.S. PATENT DOCUMENTS

| | | | |
|---|---|---|---|
| 2,495,748 | 1/1950 | Matson | 250/33 |
| 3,747,111 | 7/1973 | Fletecher et al. | 343/725 |
| 3,911,441 | 10/1975 | Stein | 343/709 |
| 3,950,754 | 4/1976 | Toman | 343/108 |
| 4,121,218 | 10/1978 | Irwin et al. | 343/895 |
| 4,329,690 | 5/1982 | Parker | 343/709 |
| 4,442,436 | 4/1984 | Newcomb | 343/722 |
| 4,559,539 | 12/1985 | Markowitz et al. | 343/725 |
| 4,725,846 | 2/1988 | Hendershot | 343/791 |
| 4,823,140 | 4/1989 | Shibata et al. | 343/713 |
| 4,868,576 | 9/1989 | Johnson, Jr. | 343/900 |
| 5,016,021 | 5/1991 | Newcomb | 343/722 |
| 5,146,235 | 9/1992 | Frese | 343/895 |
| 5,148,183 | 9/1992 | Aldama | 343/853 |

FOREIGN PATENT DOCUMENTS 350308 10/1990 European Pat. Off. ..... H01Q 5/02

*Primary Examiner*—Donald Hajec
*Assistant Examiner*—Tan Ho
*Attorney, Agent, or Firm*—Kenyon & Kenyon

[57] ABSTRACT

An antenna system includes a tubular cellular telephone antenna that is surrounded by a rubber sheath. A CB antenna is mounted above the tubular cellular telephone antenna. Each of an AM/FM, television, and marine wire antenna is wrapped around a separate portion of the rubber sheath such that these three antennas are substantially parallel to one another and are each substantially perpendicular to the tubular cellular telephone antenna.

21 Claims, 6 Drawing Sheets

FIVE-WAY ANTENNA SYSTEM

BACKGROUND OF THE INVENTION

This invention relates to antenna systems. More particularly the invention is directed to a five-way antenna system for use on automobiles, ships, airplanes, and other means of transportation on land, sea, and air for receiving TV VHF and radio signals, and for sending and receiving marine VHF, telephone and CB signals.

Antenna mounting systems are known. U.S. Pat. No. 2,495,748 describes an antenna mounting system for supporting an antenna below an airplane. In addition, multiple antenna-mounting systems are known. U.S. Pat. No. 3,747,111 describes a composite antenna feed subsystem concentrated in a small area at the prime focus of the parabola of a satellite parabolic reflector which accommodates a plurality of frequency bands. U.S. Pat. No. 3,911,441 describes a 3-way multipurpose antenna system for a radar antenna, a satellite communications antenna, and an electronic countermeasure antenna for use on a submarine. U.S. Pat. No. 3,329,690 describes a multiple antenna system for a Global Positioning System antenna, a Tactical Air Navigator antenna, and a Joint Tactical Information Distribution System antenna for use on a ship mast, and U.S. Pat. No. 4,599,539 describes a spiral antenna system which is deformed to receive one or more other antennas.

A problem with all of these antenna-mounting systems is that they do not provide multiple antennas which receive, and in some instances send, electromagnetic signals of different frequencies arranged in a small, compact configuration for easy mounting and use on land, sea, or air transport vehicles.

U.S. Pat. No. 5,148,183 describes a four-way antenna system having a hollow antenna body to which four antennas are attached. The four antennas are mounted with respect to the antenna body such that the interference between the various signals received and/or transmitted by the antennas is minimized.

OBJECTS AND SUMMARY OF THE INVENTION

An object of the present invention is to provide a multipurpose antenna system for land, sea and air transport vehicles which combines a plurality of antennas in a compact configuration for receiving and/or transmitting electromagnetic signals of various frequencies.

Another object of the present invention is to provide a compact five-way antenna system for land, sea and air transport vehicles for receiving TV VHF and radio signals, and for sending and receiving marine VHF, CB and telephone signals.

Another object of the present invention is to provide a compact five-way antenna system for land, sea, and air transport vehicles for receiving and/or sending TV VHF, marine VHF, radio, CB and telephone signals in which the five antennas are positioned such that the signals that the antennas are intended to pick-up and receive do not significantly interfere with one another.

DETAILED DESCRIPTION

Figure 1:
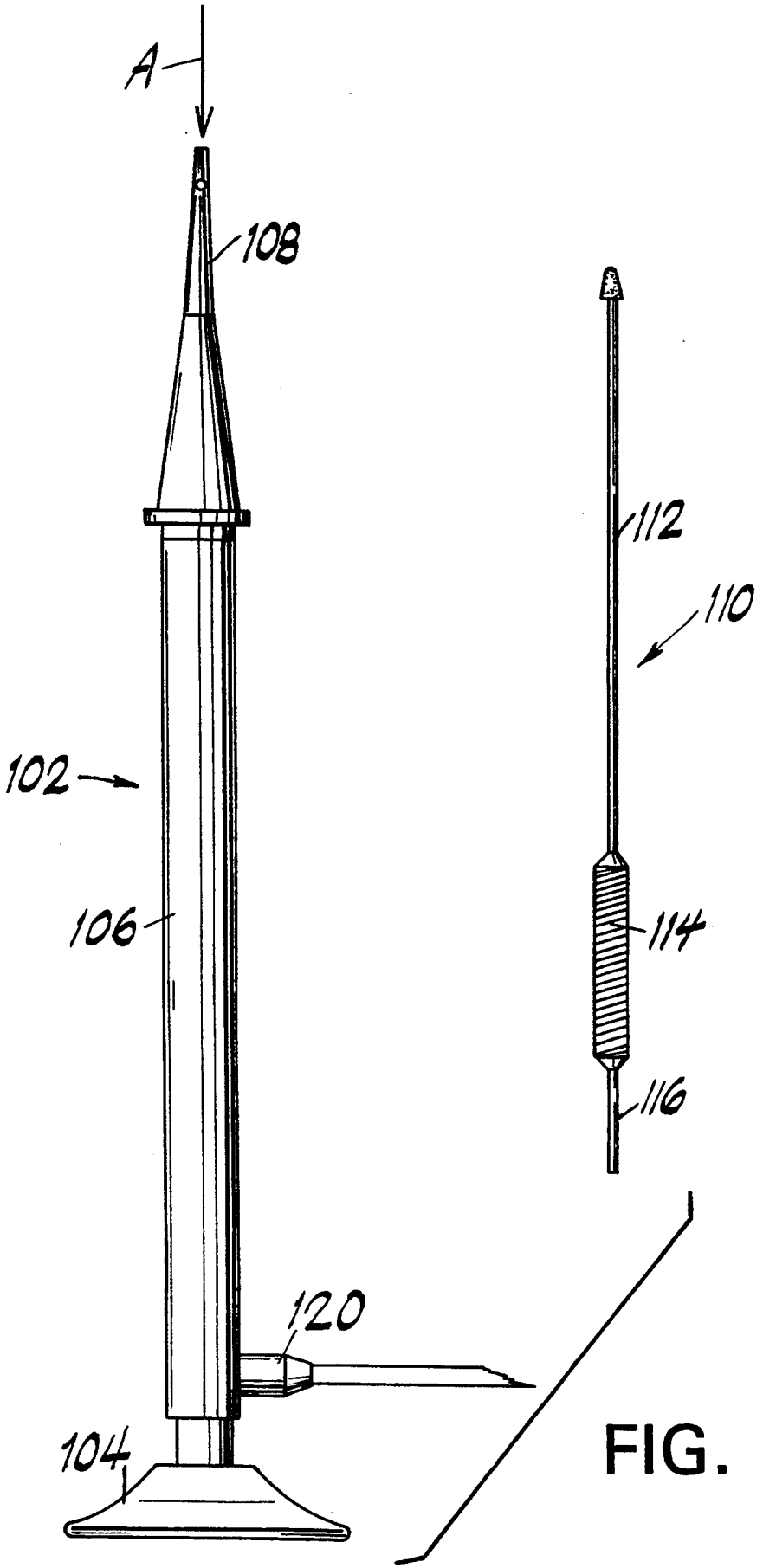
FIG. 1 shows the antenna body and the CB antenna of a first embodiment of the antenna system according to the present invention.

FIG. 1 illustrates a first embodiment of the compact five-way antenna system according to the present invention, that can be mounted on land, air and sea transport vehicles; and which is capable of receiving radio and TV VHF signals, and sending and receiving marine VHF, telephone and CB signals. The frequency ranges typically associated with the signals are:

| Signal | Frequency Range |
|---|---|
| Radio | 540–1600 kHz (AM)<br>88–108 MHz (FM) |
| VHF - TV | 30–300 MHz |
| VHF - marine | |
| Marine band (3–10 MHz, for example) | |
| Telephone (cellular) | 824–894 MHz |
| CB | 26–28 MHz |

An antenna body 102 includes a base 104 for supporting the antenna system with respect to a horizontal surface, a hollow central portion 106 for housing several of the antennas of the antenna system, and an upper tip portion 108 for receiving a CB antenna 110. The CB antenna 110 includes a CB whip 112, which may be a 13" elongated CB whip, and a copper wire 114 wound around a portion of the CB whip 112. The tip portion 108 of the antenna body 102 receives a lower portion 116 of the CB whip 112 for vertically mounting the CB antenna 110, as indicated by the arrow A.

Figure 2:
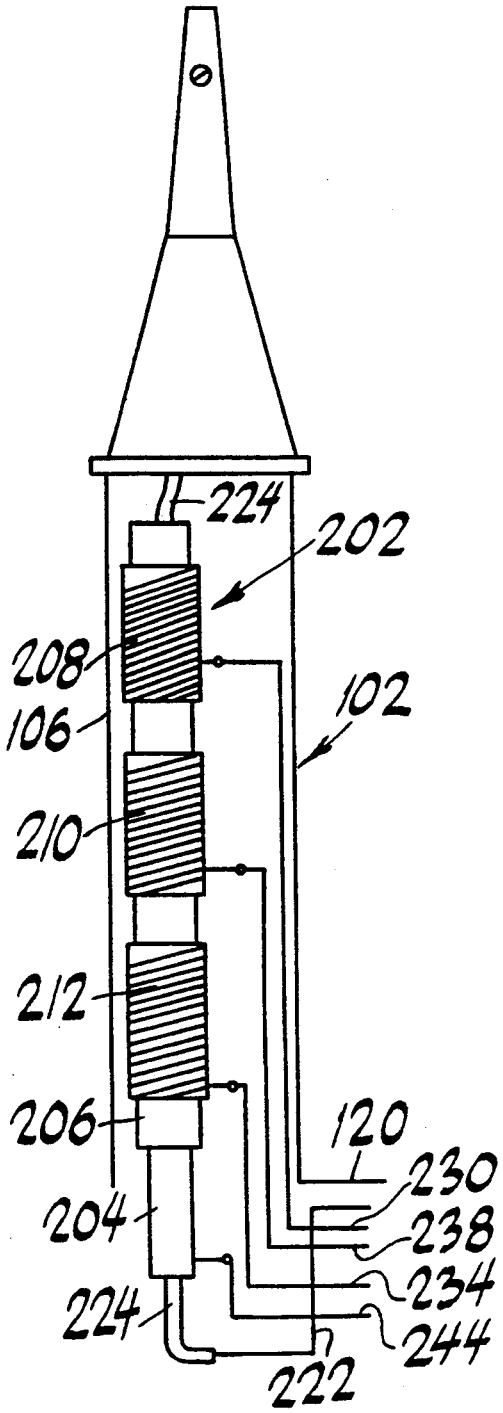
FIG. 2 shows a partial cross-sectional view of the antenna system of FIG. 1.

Referring now to FIG. 2, there is shown a partial cross-sectional view of the antenna system of FIG. 1. The antenna configuration 202 contained within the central portion 106 of the antenna body 102 is shown in greater detail in FIG. 3.

The antenna configuration 202 includes a cellular telephone antenna 204, which is preferably a vertically-oriented aluminum tube. The tubular cellular telephone antenna 204 is surrounded by an insulator, which is preferably a rubber sheath 206. An upper portion of the rubber sheath 206 is wrapped with an AM/FM-radio wire antenna 208, which is preferably a horizontally-oriented, circular-shaped copper wire. A middle portion of the rubber sheath 206 is wrapped with a television VHF wire antenna 210, which is preferably a horizontally-oriented, circular-shaped aluminum wire. A lower portion of the rubber sheath 206 is wrapped with a marine (radio) VHF wire antenna 212, which is also preferably a horizontally-oriented, circular-shaped aluminum wire.

Figure 3:
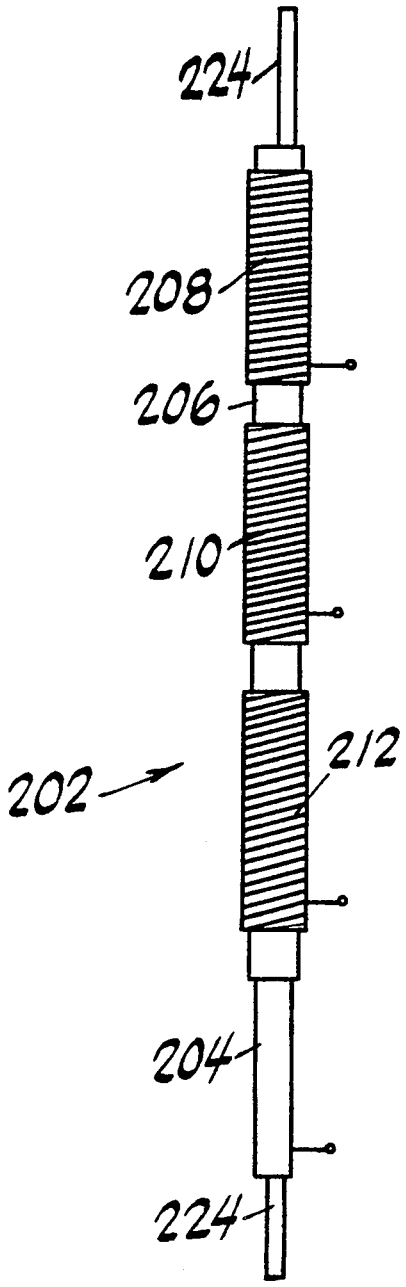
FIG. 3 shows the antenna configuration of the antenna system of FIG. 2.
Figure 6:
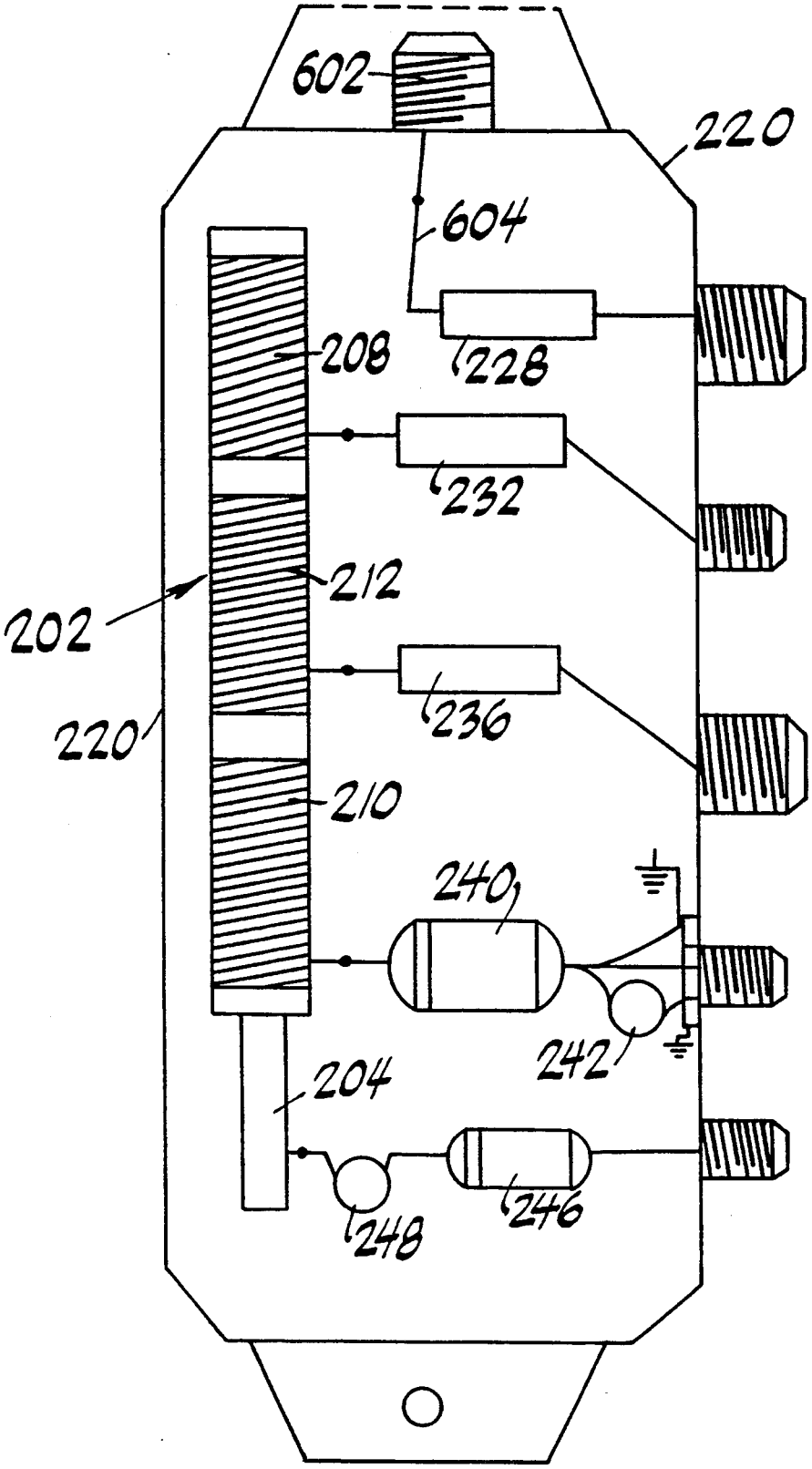
FIG. 6 shows a second embodiment of the antenna system according to the present invention.

The positioning of the AM/FM, TV and marine antennas 208, 210 and 212, respectively, relative to one another can, of course, be changed from that shown in FIG. 3, such that, for example, the marine antenna 212 is at the middle portion of the rubber sheath 206 and the TV antenna 210 is at the lower portion of the rubber sheath 206, as shown in FIG. 6.

The AM/FM, TV and marine antennas 208, 210 and 212, respectively, are separated from one another on the rubber sheath 206. These three antennas 208, 210, 212 are configured such that the windings of each of these antennas 208, 210, 212 are substantially parallel to the winding of each of the other antennas 208, 210, 212 and are substantially perpendicular to the tubular cellular telephone antenna 204. This configuration of the antennas substantially eliminates interference between the various signals received and/or transmitted by the antennas.

Figure 4:
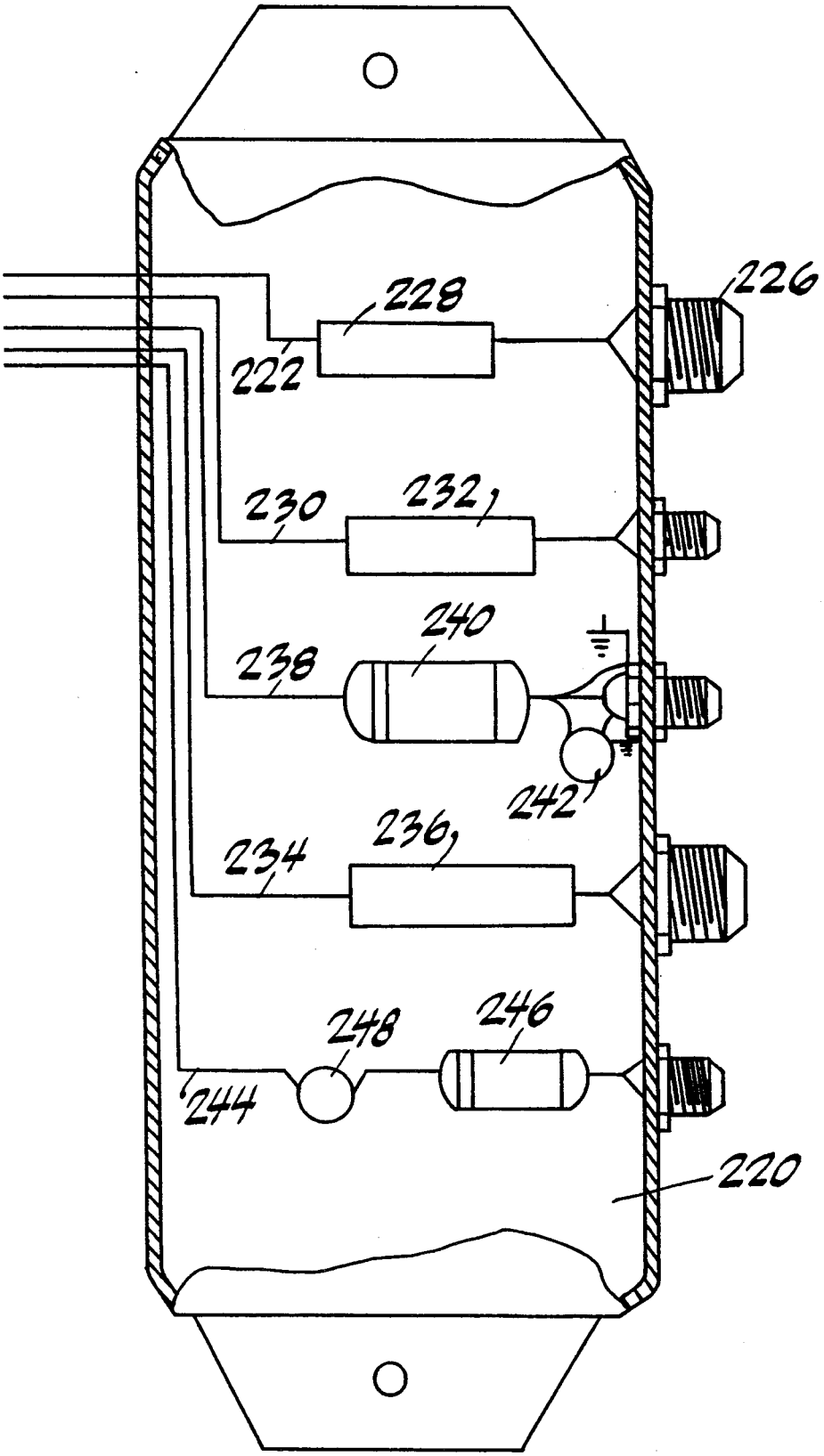
FIG. 4 shows a control box according to the present invention.

A control box 220 shown in FIG. 4 carries signals between the antennas and the units to which they correspond. The control box 220 may be located outside of (i.e., separate from) the antenna body 102, such as at the dashboard of the vehicle, or may instead be contained within the central portion 106 of the antenna body 102.

A first conducting wire 222 carries CB signals between the CB antenna 110 and a CB transmitter and receiver through the control box 220, for transmitting and receiving CB signals. In particular, as shown in FIG. 2, one end of the conducting wire 222 passes into the antenna body 102 through a projection 120, at which point the conducting wire 222 is coupled to a CB co-axial cable 224 which may extend upwardly through the center of the (hollow) tubular cellular telephone antenna to the CB antenna 110. As shown in FIG. 4, the other end of the conducting wire 222 is coupled, at the periphery of the control box 220, to a conventional CB co-axial connector 226, such as a screw-on connector, which electrically connects to a CB transmitter and receiver. A 5 watt, 0.47 ohm resistor 228 is coupled in-line with the conducting wire 222, inside the antenna box 220.

A second conducting wire 230 and an in-line 5 watt, 0.47 ohm resistor 232 likewise couple the AM/FM antenna 208 and an AM/FM receiver for receiving AM/FM radio signals.

Figure 5:
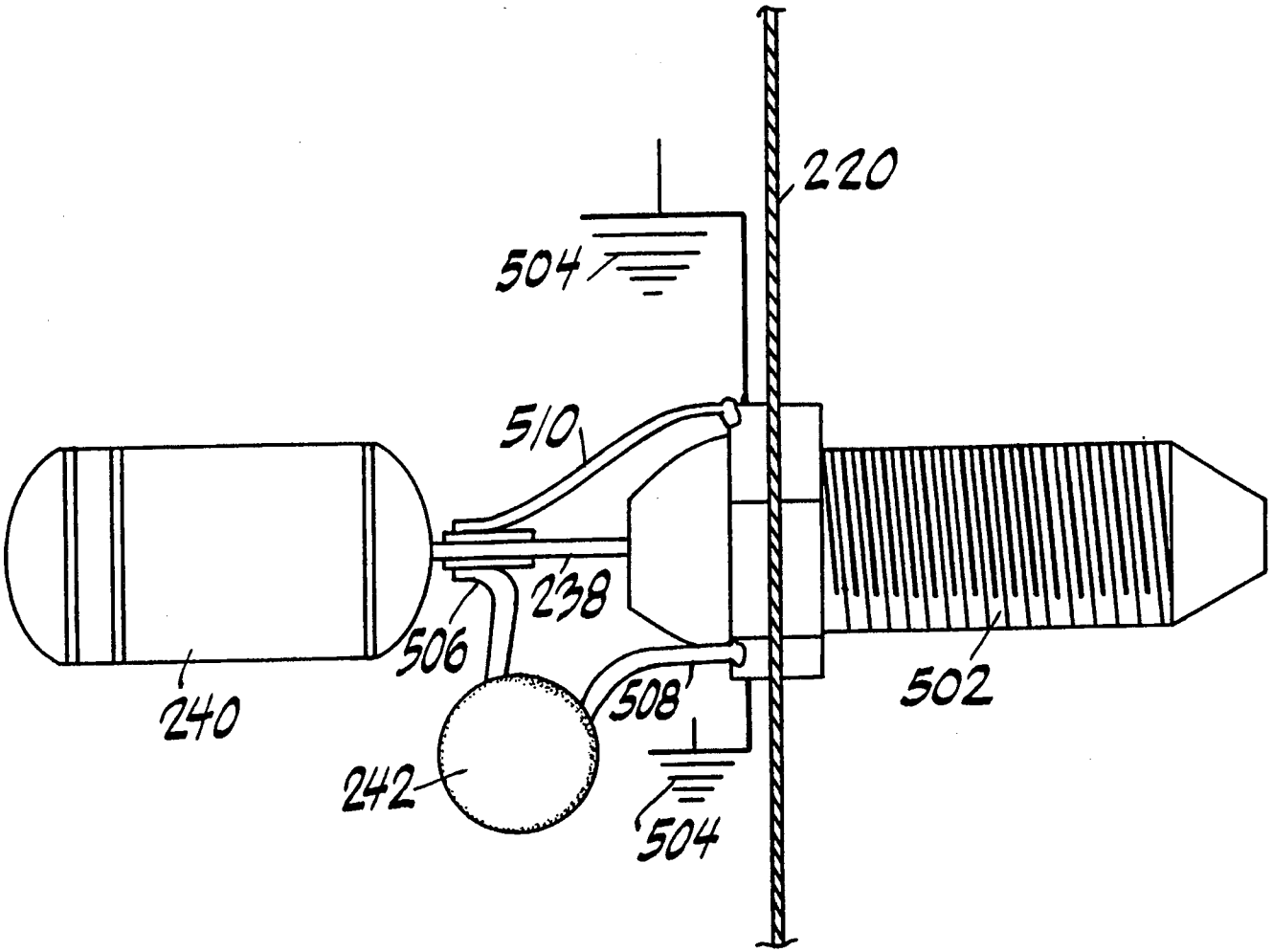
FIG. 5 shows a by-pass device according to the present invention of the control box of FIG. 4.

A third conducting wire 238 couples the TV VHF antenna 210 and a television for receiving TV VHF signals. A 35 volt, 1 farad capacitor 240 is coupled inline with the conducting wire 238. A 2 kilovolt, 103 microfarad capacitor 242, which functions as a by-pass and filtering device and assists in eliminating interference between the various signals received and/or transmitted by the antennas, may be coupled in parallel with the conducting wire 238, as shown in FIG. 5. In particular, the conducting wire 238 couples the capacitor 240 to a television co-axial connector 502, which electrically connects to the television. One terminal 506 of the by-pass capacitor 242 is coupled to the conducting wire 238, while the other terminal 508 of the by-pass capacitor 242 is coupled to ground 504. Likewise, one end of another conducting wire 510 is coupled to the conducting wire 238, while the other end of the conducting wire 510 is coupled to ground 504, as shown in FIG. 5.

A fourth conducting wire 234 and an in-line 5 watt, 0.47 ohm resistor 236 couple the marine antenna 212 and a marine VHF transmitter and receiver for transmitting and receiving marine VHF signals on a boat, for example.

A fifth conducting wire 244, along with an in-line 2 kilovolt, 103 microfarad capacitor 248 and an in-line 35 volt, 47 microfarad capacitor 246, couple the tubular cellular telephone antenna 204 and a cellular telephone for transmitting and receiving cellular telephone signals.

FIG. 6 illustrates a second embodiment of the antenna system according to the present invention, in which the antenna configuration 202 is small enough to be incorporated within the vertically-oriented control box 220. Additionally, in FIG. 6, the positions of the TV antenna 210 and the marine antenna 212 have been switched to illustrate one of the many possible alternative configurations of the antenna system according to-the present invention.

Figure 7:
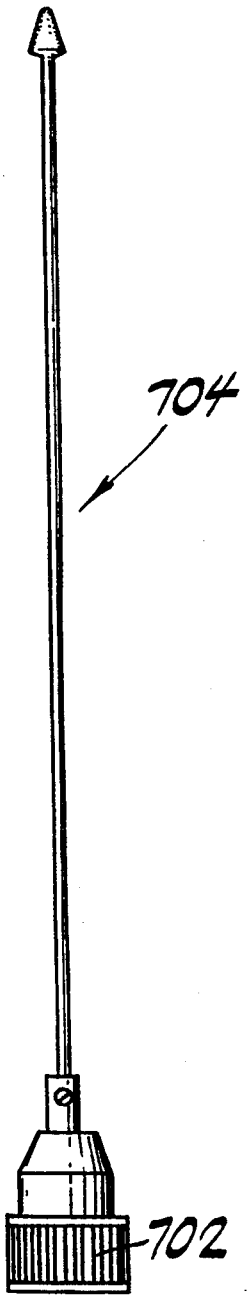
FIG. 7 shows a standard CB antenna.
Figure 8:
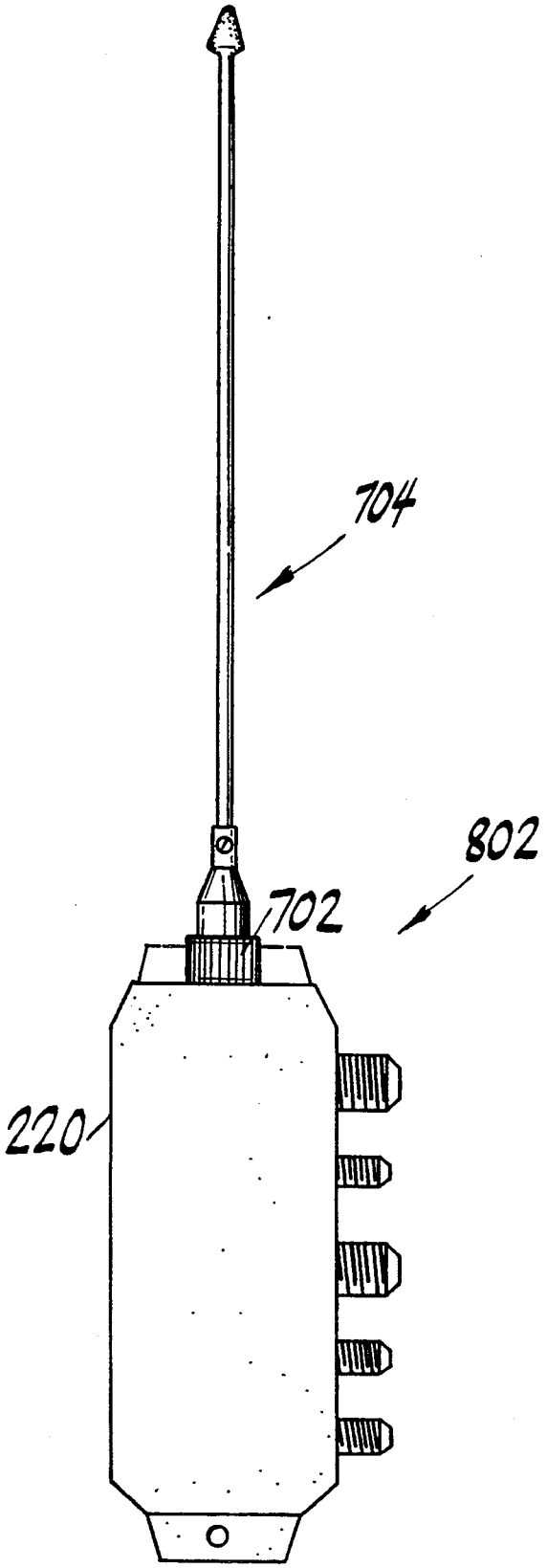
FIG. 8 shows the antenna system of FIG. 6 connected to the CB antenna of FIG. 7.

In this second embodiment of the antenna system according to the present invention, in contrast to the first embodiment, CB signals pass directly between the resistor 228 and a CB antenna connector 602 over a conducting wire 604, rather than pass through the center of the tubular cellular telephone antenna. The CB antenna connector 602 is adapted to be electrically connected to stand-alone, standard CB antennas, such as to the base 702 of the CB automobile antenna 704 shown in FIG. 7, in order to form the complete antenna system 802 shown in FIG. 8.

What is claimed is:

1. A three-way antenna system, comprising:

a first, elongated antenna having an outer surface, for sending and receiving telephone signals with an electromagnetic frequency of 824 to 894 MHz;

an insulator covering the outer surface of the first antenna;

a second antenna and a third antenna selected from the group consisting of:

a radio antenna wrapped around a portion of the insulator for receiving signals with an electromagnetic frequency of 540 to 1600 kHz and 88 to 108 MHz;

a television antenna wrapped around a portion of the insulator for receiving signals with an electromagnetic frequency of 30 to 300 MHz; and a marine antenna wrapped around a portion of the insulator for receiving signals with an electromagnetic frequency of 3 to 10 MHz; and means for transmitting the electromagnetic signals received by the first, second and third antennas between the first, second and third antennas and first, second and third receivers corresponding to the first, second and third antennas, respectively.

2. The antenna system of claim 1 wherein each of the second and third antennas is perpendicular to the first antenna.

3. The antenna system of claim 1 wherein the second antenna is parallel to the third antenna.

4. The antenna system of claim 1 wherein:

the first antenna is an aluminum tube;

the radio antenna is a copper wire;

the television antenna is an aluminum wire; and the marine antenna is an aluminum wire.

5. The antenna system of claim 1 wherein the means for transmitting includes a control box coupled between the first, second and third antennas, on one side, and the first, second and third receivers, on the other side.

6. The antenna system of claim 5 wherein the control box includes a conducting wire coupled between the television antenna and a television, and a by-pass capacitor coupled to the conducting wire.

7. The antenna system of claim 1, further comprising an antenna body having a hollow portion containing the first and second antennas.

8. The antenna system of claim 7, further comprising a CB antenna mounted to a tip portion of the antenna body for transmitting and receiving signals with an electromagnetic frequency of 26 to 28 MHz.

9. The antenna system of claim 8 wherein the CB antenna includes an elongated CB whip and a copper wire wound around a portion of the CB whip.

10. The antenna system of claim 9 wherein the first antenna is a hollow tube, and further comprising a CB cable extending through the hollow tube, a first end of the CB cable being coupled to the CB whip, and a second end of the CB cable being coupled to a CB transmitter and receiver.

11. The antenna system of claim 1 wherein the first antenna is vertically oriented, and each of the second and third antennas is horizontally oriented.

12. The antenna system of claim 1 wherein the insulator includes a rubber sheath.

13. The antenna system of claim 1 wherein:

the radio antenna is wrapped around an upper portion of the insulator;

the television antenna is wrapped around a middle portion of the insulator; and the marine antenna is wrapped around a lower portion of the insulator.

14. The antenna system of claim 1, further comprising a control box containing the first, second and third antennas.

15. A five-way antenna system, comprising:

an antenna body having a hollow portion and a tip portion;

a tubular cellular telephone antenna having an outer surface, for sending and receiving telephone signals with an electromagnetic frequency of 824 to 894 MHz, the telephone antenna being contained in the hollow portion of the antenna body;

a rubber sheath covering the outer surface of the telephone antenna;

a radio antenna wrapped around an upper portion of the rubber sheath for receiving signals with an electromagnetic frequency of 540 to 1600 kHz and 88 to 108 MHz;

a television antenna wrapped around a middle portion of the rubber sheath for receiving signals with an electromagnetic frequency of 30 to 300 MHz;

a marine antenna wrapped around a lower portion of the rubber sheath for receiving signals with an electromagnetic frequency of 3 to 10 MHz;

a CB antenna mounted to the tip portion of the antenna body for transmitting and receiving signals with an electromagnetic frequency of 26 to 28 MHz; and means for transmitting the electromagnetic signals received by the antennas between the antennas and corresponding receivers.

16. The antenna system of claim 15 wherein:

the telephone antenna is an aluminum tube;

the radio antenna is a copper wire;

the television antenna is an aluminum wire; and the marine antenna is an aluminum wire.

17. The antenna system of claim 15 wherein the means for transmitting includes a control box.

18. The antenna system of claim 17 wherein the control box includes a conducting wire coupled between the television antenna and a television, and a by-pass capacitor coupled to the conducting wire.

19. The antenna system of claim 15 wherein the CB antenna includes an elongated CB whip and a copper wire bound around a portion of the CB whip.

20. The antenna system of claim 8 wherein the telephone antenna is a hollow tube, and further comprising a CB cable extending through the hollow tube, a first end of the CB cable being coupled to the CB whip, and a second end of the CB cable being coupled to a CB transmitter and receiver.

21. The antenna system of claim 15 wherein the telephone antenna is vertically oriented.

* * * * *